US005836740A

United States Patent [19]

Wang

[11] Patent Number: 5,836,740

[45] Date of Patent: Nov. 17, 1998

[54] OUTER CASING MOUNTED AROUND A SUSPENSION ROD

[76] Inventor: Yuh-Shyong Wang, No. 5, Lane 30, Ta Chou Road, Shern Gang Hsiang, Taichung Hsien, Taiwan

[21] Appl. No.: 853,602

[22] Filed: May 9, 1997

[51] Int. Cl.[6] ..... F04D 29/52; F04D 29/64

[52] U.S. Cl. ..... 416/5; 416/244 R; 362/96; 362/360; 362/363; 362/405

[58] Field of Search ..... 416/5, 170 R, 416/210 R, 244 R; 220/4.26, 677, 682; 362/96, 360, 363, 405; 403/13, 364, 375

[56] References Cited

U.S. PATENT DOCUMENTS

| | | | |
|---|---|---|---|
| 2,330,207 | 9/1943 | England et al. | 220/682 |
| 3,741,251 | 6/1973 | Rees | 403/364 |
| 4,428,032 | 1/1984 | Workman | 416/5 |
| 4,863,346 | 9/1989 | Lin | 416/5 |
| 4,978,023 | 12/1990 | Behlmann et al. | 220/4.26 |
| 5,385,326 | 1/1995 | Bidwell | 220/4.26 |
| 5,404,285 | 4/1995 | Schonbek | 362/363 |
| 5,454,692 | 10/1995 | Davis | 416/5 |
| 5,475,578 | 12/1995 | Sevack et al. | 362/405 |
| 5,503,524 | 4/1996 | Yu | 416/5 |
| 5,593,281 | 1/1997 | Tai | 416/5 |

FOREIGN PATENT DOCUMENTS

| | | | |
|---|---|---|---|
| 1487840 | 5/1967 | France | 362/405 |
| 910153 | 11/1962 | United Kingdom | 403/364 |
| 2221273 | 1/1990 | United Kingdom | 403/364 |

*Primary Examiner*—Christopher Verdier
*Attorney, Agent, or Firm*—Charles E. Baxley, Esq.

[57] ABSTRACT

An outer casing is mounted around a suspension rod and includes a number of sections each having a first teeth structure defined in a first side thereof and a second teeth structure defined in a second side thereof and having a curvature complimentary to that of the first teeth structure. The sections are assembled to form the outer casing due to engagements between the first teeth structures and the second teeth structures.

19 Claims, 9 Drawing Sheets

OUTER CASING MOUNTED AROUND A SUSPENSION ROD

BACKGROUND OF THE INVENTION

1. Field of the Invention

The present invention relates to improved structures for outer casings mounted around a suspension rod of a ceiling fan or pendant.

2. Description of the Related Art

A ceiling fan or pendant generally includes a suspension rod extending downwardly from the ceiling to support the ceiling fan or pendant, and an outer casing is generally mounted around the suspension rod to prevent from entrance of dust or alien objects. Mounting of the outer casing is troublesome and time-consuming as fasteners, e.g, screws, bolts, or the like must be used. In addition,, manufacture of the outer casing is costly. The present invention is intended to provide improved outer casing structures which mitigate and/or obviate the above problems.

SUMMARY OF THE INVENTION

An outer casing in accordance with the present invention is mounted around a suspension rod and comprises a plurality of sections each having a first teeth structure defined in a first side thereof and a second teeth structure defined in a second side thereof and having a curvature complimentary to that of the first teeth structure. The sections are assembled to form the outer casing due to engagements between the first teeth structures and the second teeth structures.

The first teeth structure may include a fence extending from an outer side thereof for preventing disengagement of the second teeth structure. Preferably, each tooth of the second structure inclines upwardly and outwardly.

Other objects, advantages, and novel features of the invention will become more apparent from the following detailed description when taken in conjunction with the accompanying drawings.

DESCRIPTION OF THE PREFERRED EMBODIMENTS

Figure 1:
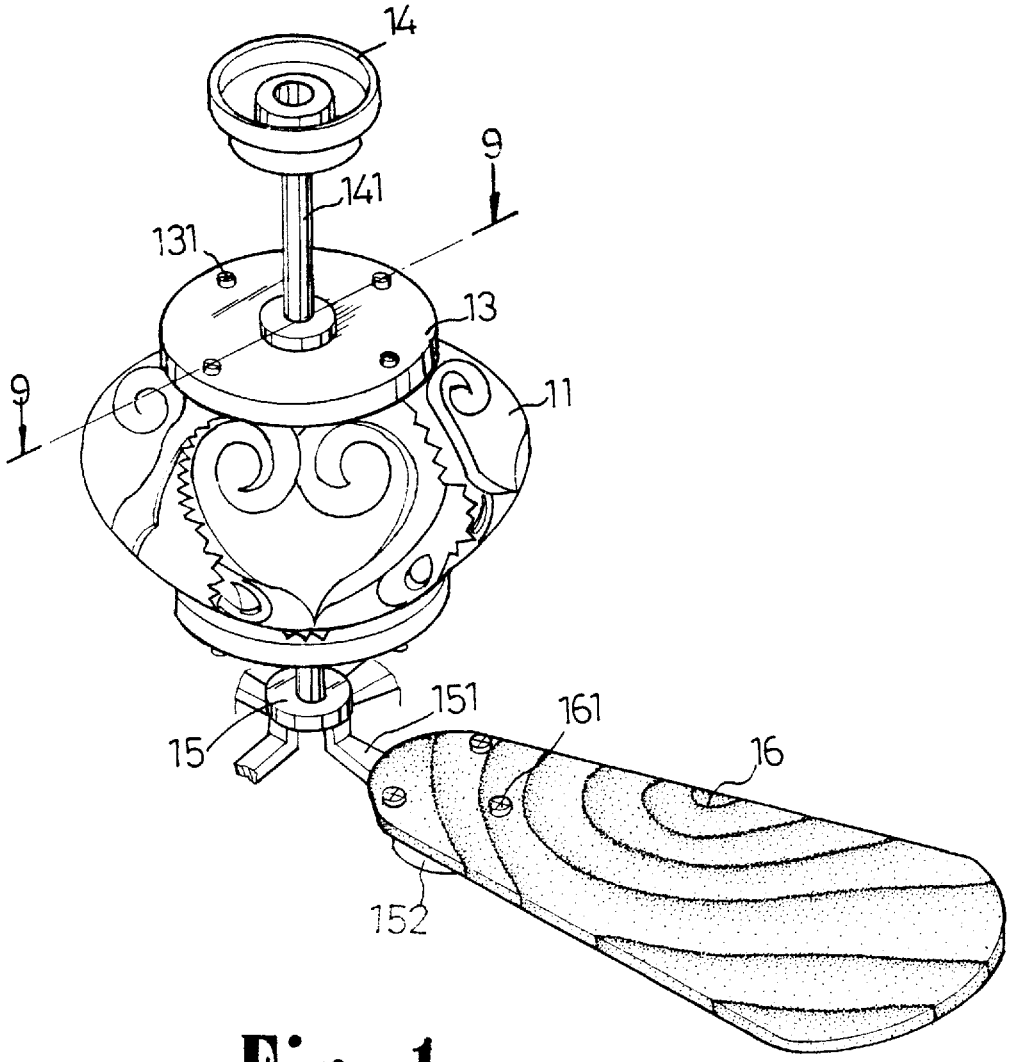
FIG. 1 is a perspective view of a ceiling fan assembly having an outer casing in accordance with the present invention.
Figures 2, 2A:
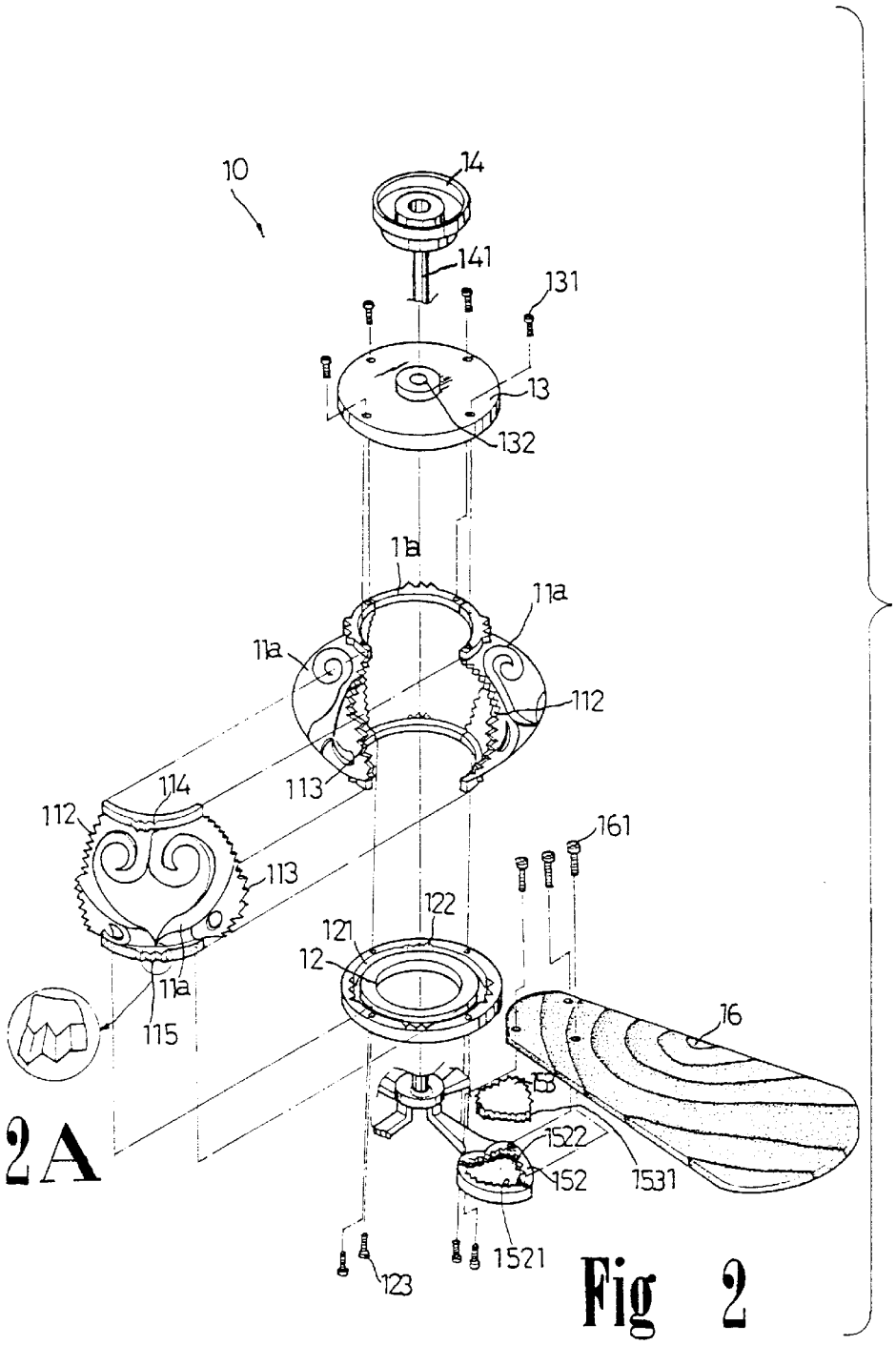
FIG. 2 is an exploded view of the ceiling fan assembly in FIG. 1.
FIG. 2A is an enlarged view of a circle in FIG. 2.

Referring to the drawings and initially to FIGS. 1 and 2, a ceiling fan assembly generally includes a rotatable suspension rod 141 mounted to a ceiling (not shown) by a mounting disc 14, and a fan means is attached to a lower end of the rotatable suspension rod 141 to rotate therewith. The present invention provides an outer casing 11 which can be mounted around the rotatable suspension rod 141 for receiving a motor (not shown) therein which drives the rod 141 and for preventing entrance of alien objects in addition to being decorative. The outer casing 11 in accordance with the present invention may include a plurality of arcuate sections 11*a* which together form the outer casing 11. Each arcuate section 11*a* has a first end and a second end in which the first end includes a first teeth structure and the second end includes a second teeth structure having a curvature complimentary to that of the first teeth structure, thereby allowing the arcuate sections to be assembled in a circle.

Figure 3:
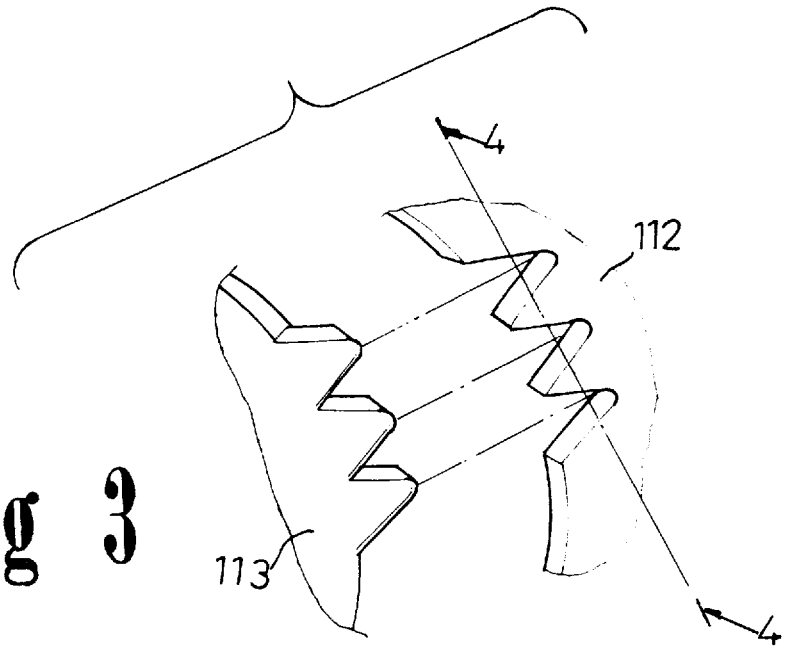
FIG. 3 is an exploded view illustrating engagement of an embodiment of teeth structures of two sections of an outer casing in accordance with the present invention.
Figure 4:
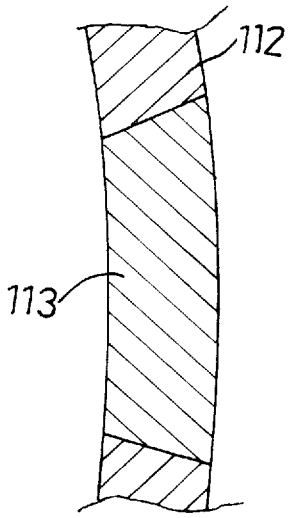
FIG. 4 is a cross sectional view taken along line 4—4 in FIG. 3.
Figure 5:
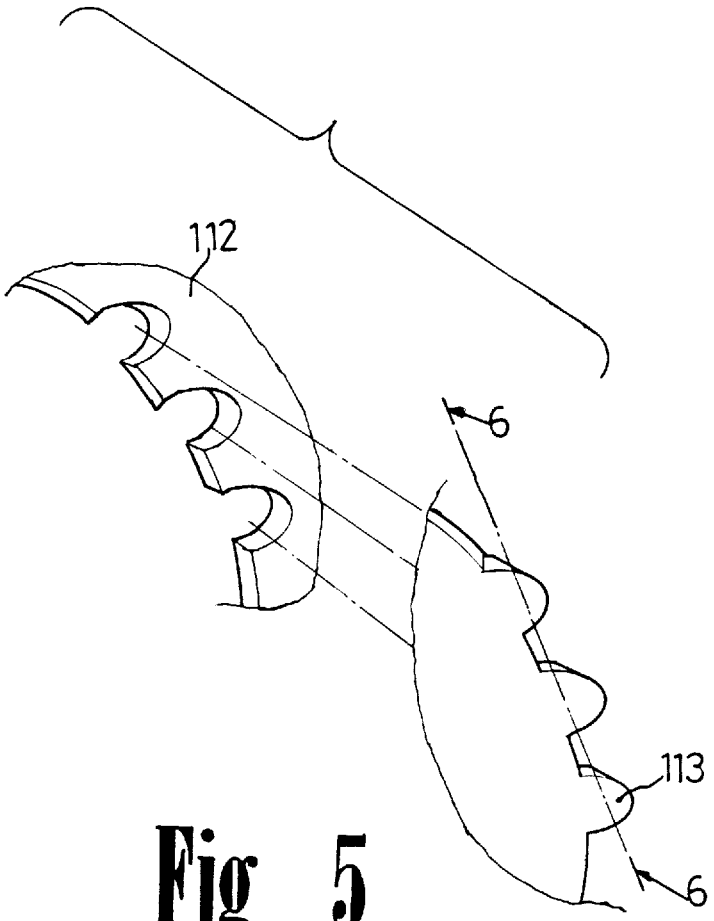
FIG. 5 is an exploded view illustrating engagement of a modified embodiment of teeth structures of two sections of an outer casing in accordance with the present invention.
Figure 6:
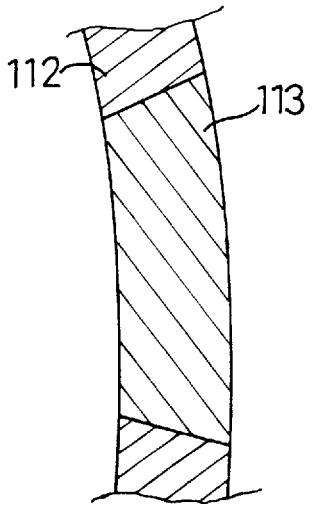
FIG. 6 is a cross sectional view taken along line 6—6 in FIG. 6.

In an embodiment of the invention, referring to FIGS. 1 to 4, the outer casing 11 includes four sections 11a each having a first teeth structure 112 extending in a vertical direction and a second teeth structure 113 having a curvature complimentary to that of the first teeth structure 112. Referring to FIGS. 3 and 4, each tooth of the second teeth structure 113 of each section 11*a* inclines upwardly and outwardly, while the first teeth structure 112 has a curvature complimentary to that of the second teeth structure 113, as shown in FIGS. 2 to 4. FIGS. 5 and 6 illustrate a modified embodiment of the teeth structures of FIGS. 3 and 4 in which only the outlines thereof are changed.

Figure 7:
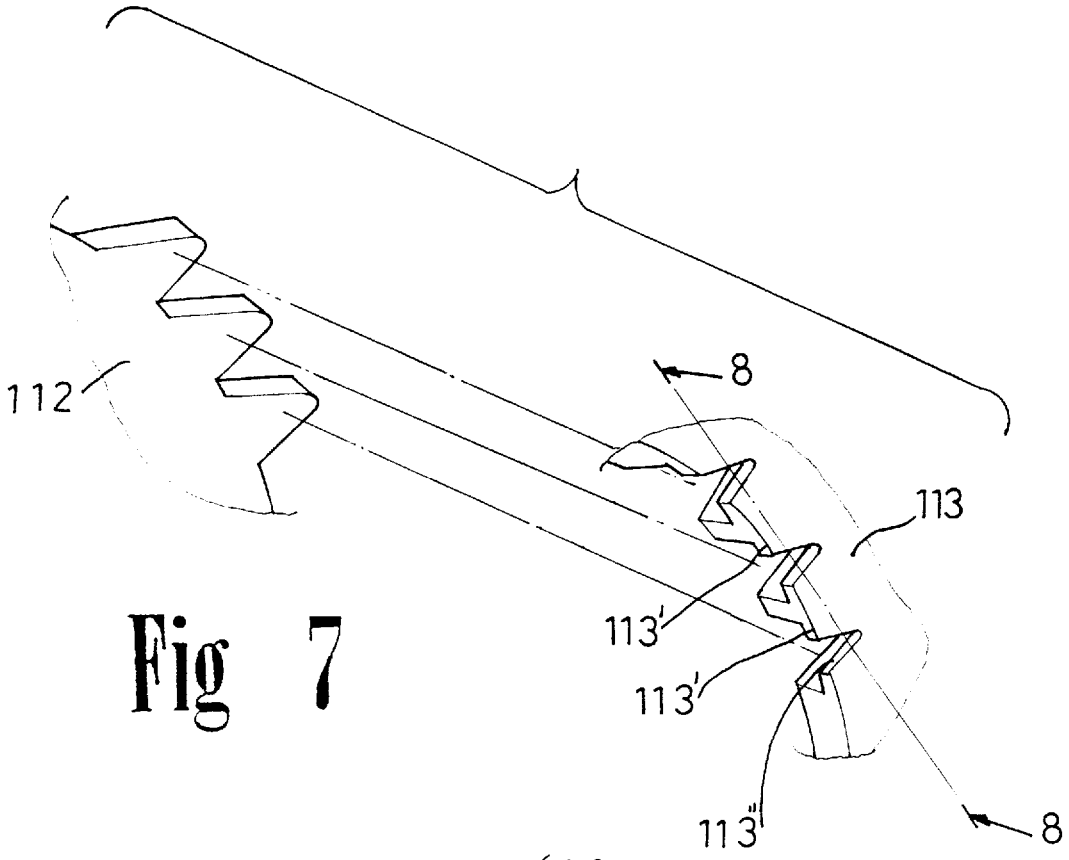
FIG. 7 is an exploded view illustrating engagement of a third embodiment of teeth structures of two sections of an outer casing in accordance with the present invention.
Figure 8:
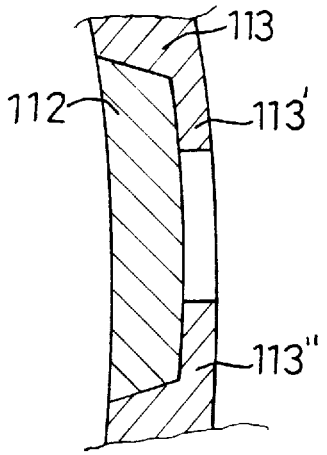
FIG. 8 is a cross sectional view taken along line 8—8 in FIG. 7.

FIGS. 7 and 8 illustrate a further modified embodiment of the teeth structures of FIGS. 3 and 4 in which each tooth of the second structure 113 of each section 11*a* inclines downwardly and outwardly, while the first teeth structure 112 has a curvature complimentary to that of the second teeth structure 113. In addition, each tooth of the second teeth structure 113 includes a fence 113' extending in an outer side thereof for restraining the first teeth structure 112 inside the fence 113'. The fence 113' may include a V-shaped cutout 113" for decorative.

Figure 9:
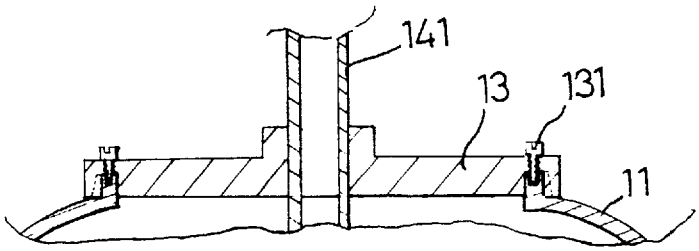
FIG. 9 is a partial sectional view taken along line 9—9 in FIG. 1.

Referring back to FIGS. 1 and 2, each section 11a further includes an upper end which has a third teeth structure 114 defined in an outer side thereof. Referring to FIGS. 2 and 9, an upper cover 13 is mounted around the upper ends of the sections 11*a* by bolts 131 and includes a teeth structure (not shown) defined in an inner periphery thereof for engagement with the third teeth structures 114 of the sections 11*a*. The upper cover 13 further includes a central bore 132 through which the suspension rod 141 extends.

Referring to FIGS. 1, 2, and 2A, each section 11*a* further includes a lower end which has a fourth teeth structure 115 defined in an outer side thereof. A lower cover 12 is mounted around the lower ends of the sections 11*a* by bolts 123 and includes a teeth structure 122 defined in an inner periphery 121 thereof for engagement with the fourth teeth structures 115 of the sections 11*a*. The lower cover 12 further includes a central bore (not labeled) through which the suspension rod 141 extends. It is appreciated that the inner teeth structure of the upper cover 13 may be identical to the teeth structure 122 of the lower cover 12. Preferably, the inner teeth structures of the upper and lower covers 13 and 12 also have inclined teeth similar to those of the teeth structure 112, while the outer teeth structures 114 and 115 have inclined teeth similar to those of the teeth structure 113.

Still referring to FIGS. 1 and 2, the fan means may include a plurality of supporting members 151 extending radially outwardly from a mounting plate 15 which, in turn, is attached to a lower end of the suspension rod 141, and a fan blade 16 is secured to each supporting member 15 by bolts 161. A hollow decorative member 152 is provided to a distal end of each supporting member 151 and includes a teeth structure 1521 defined in an inner periphery thereof. The teeth structure 1521 may include a flange 1522 extending inwardly along a periphery of a bottom portion thereof. The 38 flange 1522 provides a support for a decorative piece 153 which is received in the decorative member 152 and includes a teeth structure 1531 for engagement with the teeth structure 1521. It is appreciated that the teeth structure 1521 is similar to the teeth structure 112, and the teeth structure 1531 and the flange 1522 are similar to the teeth structure 113 and the fence 113' (see. FIGS. 7 and 8).

Figure 10:
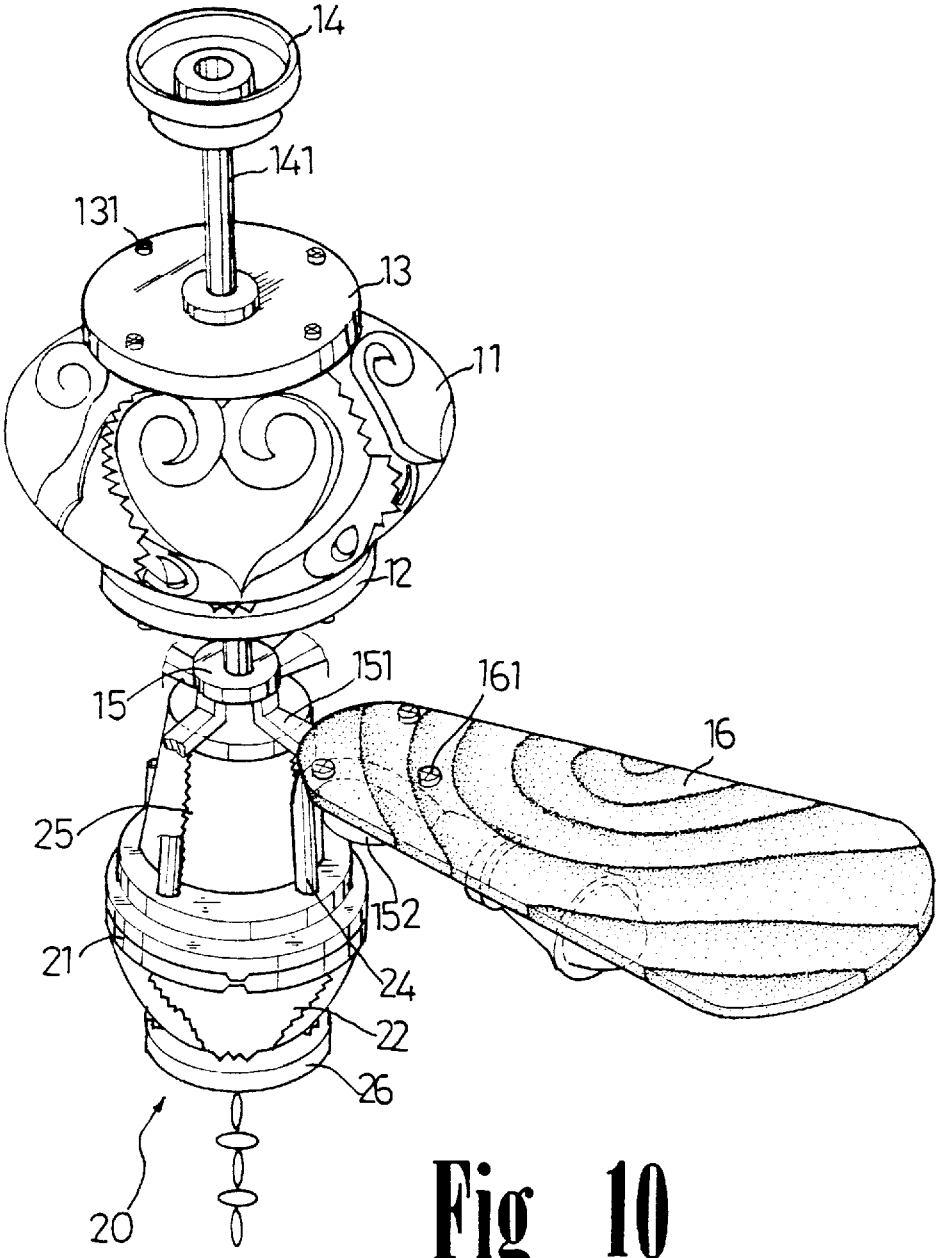
FIG. 10 is a perspective view of a ceiling fan/pendant assembly having outer casings in accordance with the present invention.
Figures 12, 12A, 12B, 12C, 12D:
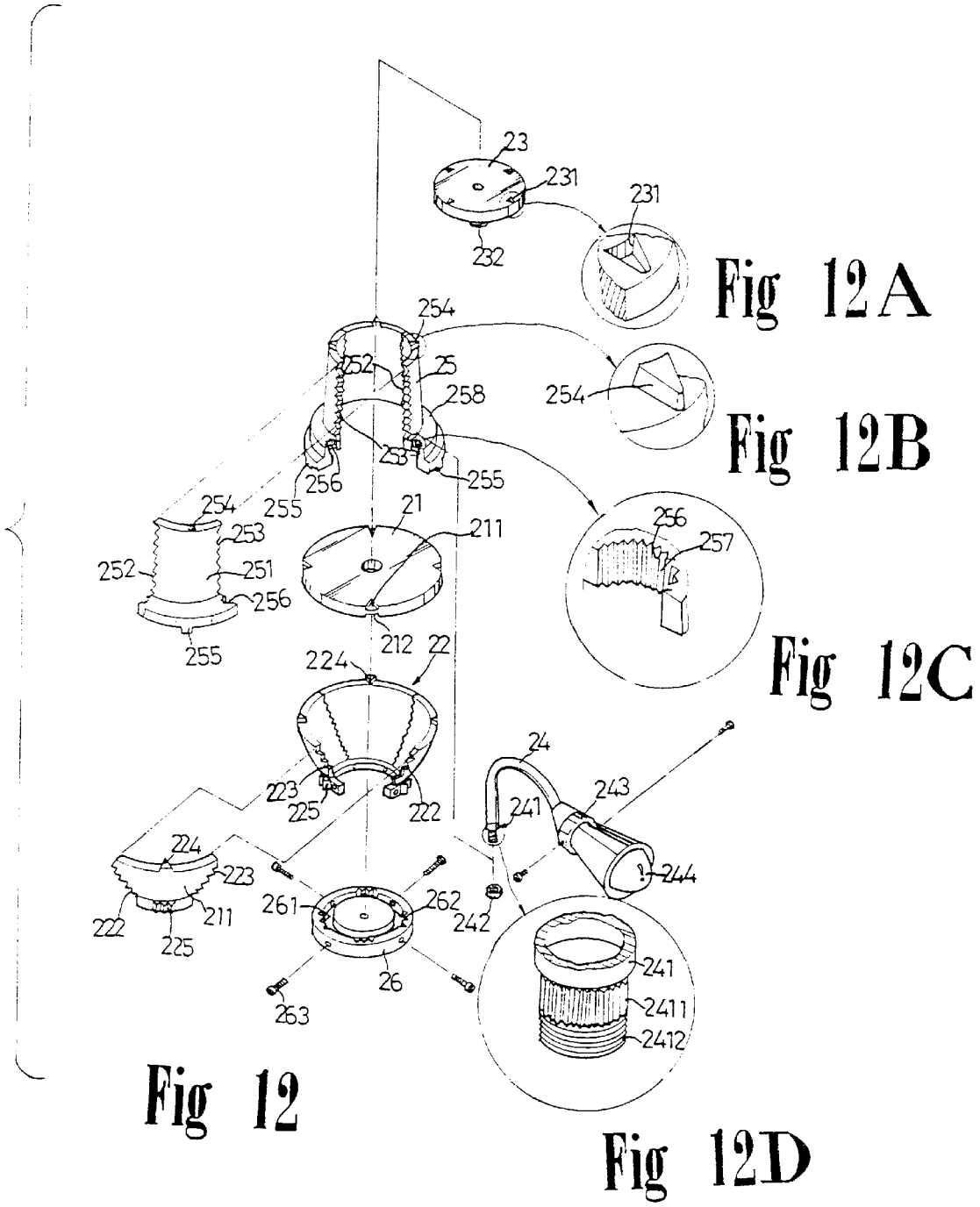
FIG. 12 is an exploded view of the pendant in FIG. 11.
FIGS. 12A, 12B, 12C, and 12D are respectively enlarged views of four circles in FIG. 12.
Figure 11:
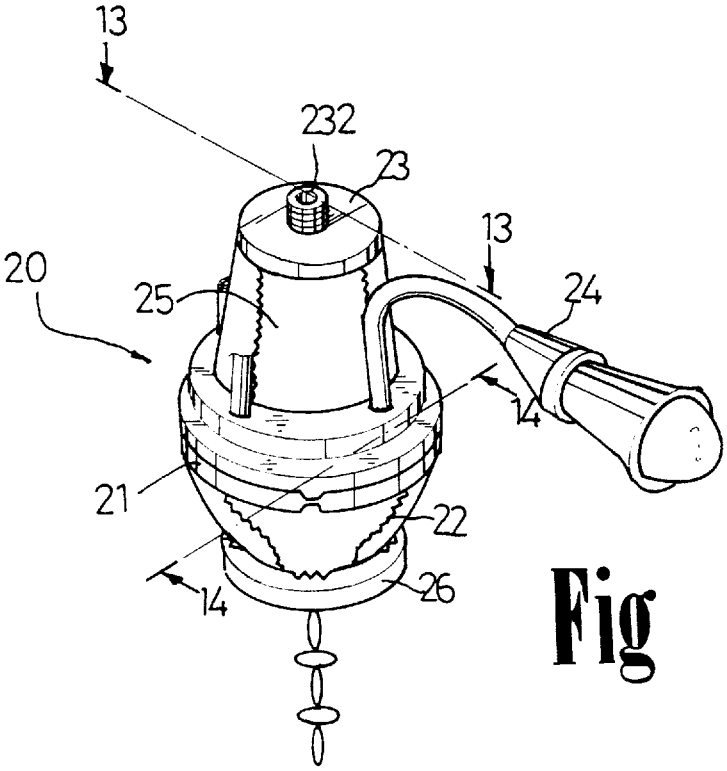
FIG. 11 is a perspective view of a pendant of the ceiling fan/pendant in FIG. 10.

Referring now to FIGS. 10 to 12, a pendant assembly 20 may be mounted under the ceiling fan for illumination purpose. The pendant assembly 20 includes a decorative upper casing 25 which includes four sections 251 each having a first teeth structure 252 extending in a vertical direction and a second teeth structure 253 having a curvature complimentary to that of the first teeth structure 252. A wedge 254 (see FIG. 12B) is formed on a top side of each section 251. Mounted on top of the upper decorative casing 25 is a circular plate 23 which includes a stud 232 on an upper side thereof for engaging with a screw hole (not shown) defined in an underside of the mounting plate 15. The circular plate 23 further includes a number of openings 231 (see FIG. 12A) defined in an underside thereof for fittingly receiving the wedges 254 of the upper decorative casing 25.

Figure 13:
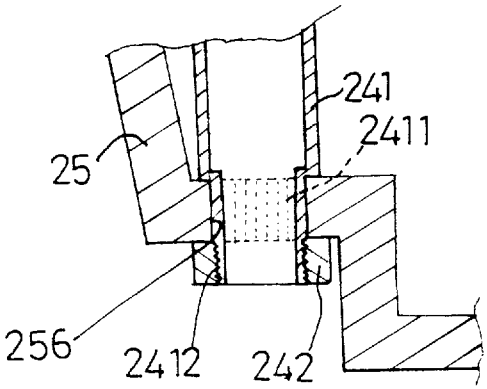
FIG. 13 is a partial sectional view taken along line 13—13 in FIG. 11.
Figure 14:
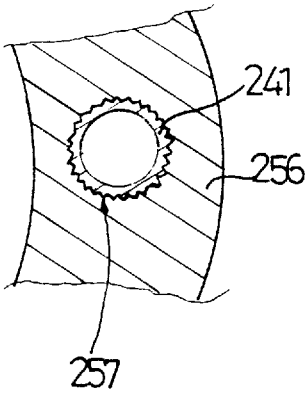
FIG. 14 is a partial sectional view taken along line 14—14 in FIG. 11.

Each section 251 further includes a bulge 258 formed on a lower end thereof, and a second wedge 255 is formed on an underside of the bulge 258. Referring to FIGS. 12 to 14, an engaging hole 256 is defined in the bulge 258 in which an inner periphery defining the engaging hole 256 includes a vertically extending teeth structure 257, as shown in FIG. 12C. In this embodiment, the engaging hole 256 is only a half, and two half engaging holes 256 of two adjacent sections 251 form a complete engaging hole. Alternatively, the bulge 258 may include a complete engaging hole. A support arm 24 has a first end 241 securely received in the engaging hole 256 and a second end 243 to which a bulb 244 is attached. As shown in FIG. 12D, an outer periphery of the first end 241 of the support arm 24 includes a vertically toothed upper portion 2411 for engaging with the teeth structure 257 and a threaded lower portion 2412 which extends beyond the engaging hole 256 and to which a nut 242 is mounted, as shown in FIG. 13. Preferably, the teeth structure 257 of the engaging hole 256 and the vertically toothed upper portion 2411 of the first end 141 of the support arm 140 taper downwardly to provide a better positioning effect.

A separation plate 21 is mounted below the bulge 258 and includes a number of recesses 211 for fittingly receiving the second wedges 255. Mounted below the separation plate 21 is a lower casing 22 which includes a compartment for receiving wires (not shown) and electric elements (not shown). As can be seen in FIG. 12, the lower casing 22 includes four sections 221 each having a first arcuate teeth structure 222 and a second arcuate teeth structure 223 having a curvature complimentary to that of the first arcuate teeth structure 222. Each section 221 includes a third wedge 224 formed on an upper side thereof for engaging with an associated recess 212 defined in an underside of the separation plate 21. It is appreciated that the wedges 254, 224, and 255 have inclined edges, while the corresponding openings 231 and recesses 212 and 211 are defined by correspondingly formed inclined edges to provide secure engagements therebetween. In addition, a lower cap 26 is mounted around lower ends of the sections 251 by bolts 263, in which the lower cap 26 includes a teeth structure 262 defined in an inner periphery 261 thereof for engaging with teeth structure 225 formed on outer sides of the sections 251. Again, the teeth structure 262 and 225 may be identical to the teeth structures 122 and 115 in FIG. 2.

It is appreciated that the outer casing in accordance with the present invention can be mounted around the suspension rod 141 of either a ceiling fan or a lamp assembly. The outer casing can also be mounted around the common suspension rod 141 of the ceiling fan and the ceiling lamp, as shown in FIG. 10.

Although the invention has been explained in relation to its preferred embodiment, it is to be understood that many other possible modifications and variations can be made without departing from the spirit and scope of the invention as hereinafter claimed.

What is claimed is:

1. A ceiling fan/pendant assembly, comprising:

a rotatable suspension rod extending downwardly from a ceiling;

a fan means attached to the rotatable suspension rod to rotate therewith;

an outer casing mounted around the rotatable suspension rod;

a pendant assembly mounted below the fan means and including a plurality of lamps attached to the outer casing;

the outer casing including a plurality of sections each having a first teeth structure defined in a first side thereof and a second teeth structure defined in a second side thereof and having a curvature complimentary to that of the first teeth structure, the sections being assembled to form the outer casing due to engagements between the first teeth structures and the second teeth structures.

2. The ceiling fan/pendant assembly according to claim 1, wherein each tooth of the second structure inclines upwardly and outwardly.

3. The ceiling fan/pendant assembly according to claim 1, wherein the first teeth structure includes a fence extending from an outer side thereof for preventing disengagement of the second teeth structure, with said fence extending on said entire teeth structure.

4. An outer casing adapted to be mounted around a suspension rod, the outer casing comprising a plurality of sections each having a first teeth structure defined in a first side thereof and a second teeth structure defined in a second side thereof and having a curvature complimentary to that of the first teeth structure, the sections being assembled to form the outer casing due to engagements between the first teeth structures and the second teeth structures.

5. The outer casing according to claim 1, wherein each tooth of the second structure inclines upwardly and outwardly.

6. The outer casing according to claim 4, wherein the first teeth structure includes a fence extending from an outer side thereof for preventing disengagement of the second teeth structure, with said fence extending on said entire first teeth structure.

7. A ceiling fan assembly, comprising:

a rotatable suspension rod extending downwardly from a ceiling;

a fan means attached to the rotatable suspension rod to rotate therewith;

an outer casing mounted around the rotatable suspension rod, the outer casing including a plurality of sections each having a first teeth structure defined in a first side thereof and a second teeth structure defined in a second side thereof and having a curvature complimentary to that of the first teeth structure, the sections being assembled to form the outer casing due to engagements between the first teeth structures and the second teeth structures.

8. The ceiling fan assembly according to claim 7, wherein each tooth of the second structure inclines upwardly and outwardly.

9. The ceiling fan assembly according to claim 7, wherein the first teeth structure includes a fence extending from an outer side thereof for preventing disengagement of the second teeth structure, with said fence extending on said entire first teeth structure.

10. A ceiling fan assembly comprising:

a rotatable suspension rod extending downwardly from a ceiling;

a fan means attached to the rotatable suspension rod to rotate therewith;

an outer casing mounted around the rotatable suspension rod, the outer casing including a plurality of sections each having a first teeth structure defined in a first side thereof and a second teeth structure defined in a second side thereof and having a curvature complimentary to that of the first teeth structure, the sections being assembled to form the outer casing due to engagements between the first teeth structures and the second teeth structures; wherein each said section further includes an upper end which has a third teeth structure defined in an outer side thereof, and an upper cover is mounted around the upper ends of the sections and includes a teeth structure defined in an inner periphery thereof for engagement with the third teeth structures of the sections.

11. The ceiling fan assembly according to claim 10, wherein each said section further includes a lower end which has a fourth teeth structure defined in an outer side thereof, and a lower cover is mounted around the lower ends of the sections and includes a teeth structure defined in an inner periphery thereof for engagement with the fourth teeth structures of the sections.

12. A ceiling fan/pendant assembly comprising:

a rotatable suspension rod extending downwardly from a ceiling;

a fan means attached to the rotatable suspension rod to rotate therewith;

an outer casing mounted around the rotatable suspension rod;

a pendant assembly mounted below the fan means and including a plurality of lamps attached to the outer casing;

the outer casing including a plurality of sections each having a first teeth structure defined in a first side thereof and a second teeth structure defined in a second side thereof and having a curvature complimentary to that of the first teeth structure, the sections being assembled to form the outer casing due to engagements between the first teeth structures and the second teeth structures, wherein each said section further includes an upper end which has a third teeth structure defined in an outer side thereof and an upper cover is mounted around the upper ends of the sections and includes a teeth structure defined in an inner periphery thereof for engagement with the third teeth structures of the sections.

13. The ceiling fan/pendant assembly according to claim 12, wherein each said section further includes a lower end which has a fourth teeth structure defined in an outer side thereof, and a lower cover is mounted around the lower ends of the sections and includes a teeth structure defined in an inner periphery thereof for engagement with the fourth teeth structures of the sections.

14. The ceiling fan/pendant assembly according to claim 13, wherein the suspension rod further includes a mounting plate mounted around a lower end thereof, a plurality of supporting members extend radially outwardly from the mounting plate, and a fan blade is securely attached to each said supporting member.

15. The ceiling fan/pendant assembly according to claim 14, wherein the pendant assembly includes:

a decorative upper casing including a plurality of sections each having a fifth teeth structure extending in a vertical direction and a sixth teeth structure having a curvature complimentary to that of the fifth teeth structure, each said section of said decorative upper casing having a first wedge formed on a top side thereof;

a circular plate mounted on top of the decorative upper casing, the circular plate including a stud on an upper side thereof for engaging with the mounting plate, the circular plate further including a number of openings defined in an underside thereof for fittingly receiving the first wedges of the upper decorative casing;

each said section of said decorative upper casing further including a bulge formed on a lower end thereof, and the bulge having a second wedge formed on an underside thereof and an engaging hole defined therein;

a support arm having a first end securely received in each said engaging hole and a second end to which a bulb is attached;

a separation plate mounted below the bulge and including a number of first recesses defined in an upper side thereof for fittingly receiving the second wedges and a number of second recesses defined in an underside thereof; and a lower casing mounted below the separation plate and including a compartment therein, the lower casing including a number of sections each having a seventh teeth structure and an eighth teeth structure having a curvature complimentary to that of the seventh teeth structure, each said section of said lower casing including a third wedge formed on an upper side thereof for engaging with an associated said second recess of the separation plate.

16. The ceiling fan/pendant assembly according to claim 15, wherein an inner periphery defining the engaging hole includes a vertically extending teeth structure, and the first end of the support arm includes an outer periphery having a vertically toothed upper portion for engaging with the teeth structure and a threaded lower portion.

17. The ceiling fan/pendant assembly according to claim 16, wherein the teeth structure of the engaging hole and the vertically toothed upper portion of the first end of the support arm taper downwardly.

18. The ceiling fan/pendant assembly according to claim 15, wherein the first wedges, the second wedges, and the third wedges have inclined edges, while the corresponding openings and said first recesses and said second recesses are defined by correspondingly formed inclined edges to provide secure engagements therebetween.

19. The ceiling fan/pendant assembly according to claim 18, wherein each said section of said lower casing includes a ninth teeth structure defined in an outer side of a lower end thereof, and further comprises a lower cap mounted around the sections of the lower casing, in which the lower cap includes a teeth structure defined in an inner periphery thereof for engaging with the ninth teeth structures formed on the outer sides of the sections of the lower casing.

* * * * *